US007057547B2

(12) United States Patent
Olmsted et al.

(10) Patent No.: US 7,057,547 B2
(45) Date of Patent: Jun. 6, 2006

(54) MOUNTED REMOTE CONTROL UNIT WITH PLUG-IN MODULE INTERFACE

(75) Inventors: Robert J. Olmsted, Wood Dale, IL (US); James J. Fitzgibbon, Batavia, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 417 days.

(21) Appl. No.: 10/152,458

(22) Filed: May 21, 2002

(65) Prior Publication Data

US 2004/0222913 A1 Nov. 11, 2004

(51) Int. Cl.
*G08C 17/00* (2006.01)

(52) U.S. Cl. ..... 341/176; 340/825.69

(58) Field of Classification Search ..... 340/5.6, 340/5.7, 5.71, 5.51, 5.22, 825.72, 5.2, 5.23; 341/76, 176; 318/66, 280, 283, 266
See application file for complete search history.

(56) References Cited

U.S. PATENT DOCUMENTS 5,969,637 A * 10/1999 Doppelt et al. ..... 340/825.69
6,037,727 A * 3/2000 Kawanobe et al. ..... 318/286
6,285,912 B1 9/2001 Ellison et al.
6,333,698 B1 12/2001 Roddy
RE37,784 E 7/2002 Fitzgibbon et al.
6,439,009 B1 * 8/2002 Heese et al. ..... 70/92
6,560,123 B1 5/2003 de Varennes et al.
6,588,153 B1 * 7/2003 Kowalczyk ..... 49/380
6,703,962 B1 * 3/2004 Marics et al. ..... 341/176

* cited by examiner

*Primary Examiner*—Michael Horabik
*Assistant Examiner*—Hung Q. Dang
(74) *Attorney, Agent, or Firm*—Fitch, Even, Tabin & Flannery

(57) ABSTRACT

A fixed position remote control unit 20 as used with a movable barrier operator 11 has an externally accessible plug-in module interface 25. This interface 25 operably couples to the link 23 and 24 between the remote control unit 20 and the operator 11. So configured, a plug-in module 40 that docks and couples with this plug-in module interface 25 can receive operating (or charging) power from the movable barrier operator 11, exchange signaling with the movable barrier operator 11, or both. The ability to readily exchange signaling without invasive wiring permits a wide variety of plug-in modules 40 to be utilized.

23 Claims, 4 Drawing Sheets

MOUNTED REMOTE CONTROL UNIT WITH PLUG-IN MODULE INTERFACE

TECHNICAL FIELD

This invention relates generally to movable barrier operators and more particularly to remotely mounted control units as used therewith.

BACKGROUND

Movable barrier operators are well understood in the art and include a wide variety of garage door openers (with both residential and commercial/industrial variations being available), sliding and swinging gates, rolling shutters, and so forth. Such operators usually include a programmable platform comprising a programmable gate array, a microcontroller, a microprocessor, or the like that controls various operational states of the operator (including movement of a corresponding barrier, light operation, state monitoring, unauthorized entry detection, and so forth). Prior art operators sometimes have one or more user accessible controls to allow for various modifications and/or installation actions to be effected. For the most part, controls to effect such actions are usually located either on the base unit of the operator itself and/or on a wireless remote control unit.

In addition to the above, many operators also include a remote control unit that is at least semi-permanently mounted remotely from the movable barrier operator itself. Such remote control units usually have one or more push buttons to allow an operator to control the opened/closed state of the movable barrier and/or a lighting unit provided integral to the movable barrier operator. These kinds of remote control units are usually coupled to the movable barrier operator by two electrical conductors and are themselves mounted on a wall or other fixed surface in or near the room to which access is at least partially controlled by the corresponding movable barrier.

Many consumers exhibit considerable price sensitivity when selecting a particular movable barrier operator. At the same time, however, many consumers desire a movable barrier operator having one or more specific features or conveniences. Unfortunately, the cost to the consumer becomes generally unacceptable when combining numerous features with a given movable barrier operator; while a given consumer may be willing to pay a higher price for an operator having the features that he or she desires, many are unwilling to pay an even higher price for an operator having both the features that they wish and additional features for which they have no desire.

Many movable barrier operators tend to be relatively reliable and long-lived. As a result, a user may become dissatisfied with a previously installed and otherwise properly functioning movable barrier operator because the operator lacks one or more features that the user now desires. With very few exceptions, in general such a user must remove the old operator and install a new operator having the desired features or simply do without the desired features. In those few instances when a new feature can be retrofitted to a previously installed movable barrier operator, the retrofitting itself can constitute a relatively complicated process. The process may require trained personnel, special equipment, and/or invasive retrofitting that can void warranties and otherwise dissuade a consumer from pursuing such an option.

BRIEF DESCRIPTION OF THE DRAWINGS

The above needs are at least partially met through provision of the mounted remote control unit with plug-in module interface described in the following detailed description, particularly when studied in conjunction with the drawings, wherein.

Figure 1:
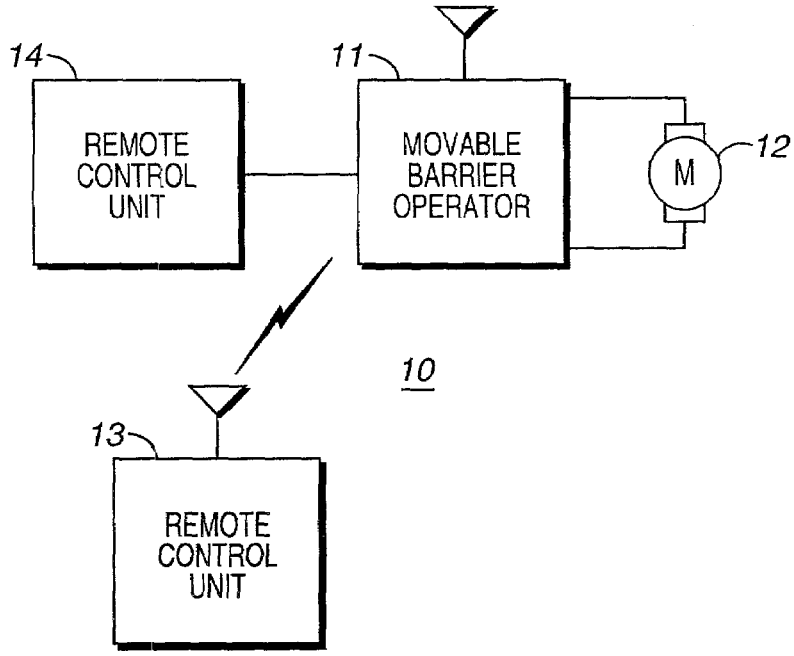
FIG. 1 (PRIOR ART)
FIG. 1 comprises a block diagram of a representative prior art movable barrier operator system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION

Generally speaking, pursuant to these various embodiments, a remote control unit for use with a movable barrier operator includes a housing that is adapted and configured to be remotely mounted from the movable barrier operator. At least one user interface (such as, but not limited to, a push button) that is at least partially disposed within the housing and that is at least partially accessible on an exterior surface of the housing permits control of various operator functions, such as barrier movement and/or lighting control. A movable barrier interface operably couples the user interface to the movable barrier operator to permit such functionality. Depending upon the particular design, this interface carries voltage from the operator to the remote control unit, one or more signals therebetween, or both. Lastly, the remote control unit includes an externally accessible plug-in module interface.

The plug-in module interface permits one or more plug-in modules to be operably coupled to the remote control unit. In one embodiment, the plug-in module draws operating power from the remote control unit (via the voltage that is provided by the movable barrier operator). Such power can be used to either power the plug-in module while coupled and/or to recharge a portable power source within the plug-in module. In another embodiment, the plug-in module receives signals from the movable barrier operator (such as, for example, information to be displayed or transmitted or diagnostic information), or provides signals to the movable barrier operator (such as, for example, feature selection codes, force settings, or sensor information), or both. So configured, a wide variety of additional features and/or functions can be readily added to an existing movable barrier operator without necessarily requiring complicated or invasive retrofitting or specially trained personnel.

The plug-in modules themselves can be many and varied, including flashlights, passive infrared detectors, service tools, supplemental user interfaces, displays, wireless transmitters, receivers, or transceivers, audio transducers, and even wireless remote control units, to name a few. Such modules can draw useful power via the interface (either for immediate use and/or for later uncoupled use), can source and/or receive information to and from the movable barrier operator, or both.

The cost effective flexibility realized through these various embodiments permits a reasonably priced movable barrier operator to be offered in conjunction with a variety of supplementary features and functions that a consumer can select to suit one or more specific requirements. In addition, features and functions that are developed and offered subsequent to the installation of the movable barrier operator can be supported through appropriate plug-in modules, thereby also allowing the consumer to acquire and effect usage of such later developments without requiring a concurrent trading out of the basic movable barrier operator itself.

Referring now to FIG. 1, a typical movable barrier operator system 10 includes a movable barrier operator 11 that couples to and controls a motor 12. The motor 12 couples through an appropriate drive mechanism (not shown) to the movable barrier (not shown). Operation on the motor in a first direction of rotation will usually cause the movable barrier to move in a corresponding first direction (such as from an opened position to a closed position) and operation of the motor in a second direction of rotation will usually cause the movable barrier to move in a corresponding second direction (such as from the closed position to the opened position). The movable barrier operator 11 will often include a wireless transceiver or receiver such that the operator 11 can receive remote control signals from a handheld portable remote control unit 13. Such a portable unit 13 can be carried, for example, in a vehicle to permit convenient operation of the movable barrier operator 11 from within the vehicle. Also, such systems 10 often include a fixed-position remote control unit 14 that usually couples to the movable barrier operator 11 via a wired link (such as a two conductor wired link). Such a fixed-position remote control unit 14 is usually mounted on a wall or other fixed object and relatively proximal to some point of access to the room or area that features the movable barrier. For example, in a garage having a garage door opener, a fixed-position remote control unit will often be mounted at convenient height near the door that provides access between the garage and the interior of the house.

Many such fixed-position remote control units have at least one push button switch and often feature two or more such switches. A not-unusual three button unit will provide a first switch to control the movement of the movable barrier, a second switch to control a worklight, and a third switch to switch the movable barrier operator in and out of a vacation mode of operation (in a vacation mode, for example, the movable barrier operator may be prohibited from responding to wireless remote control signals). In addition, one or more lights are often provided (such as one or more light emitting diodes) to provide indicia of various operational states and/or to facilitate locating and accessing the switches in a darkened room.

Figure 2:
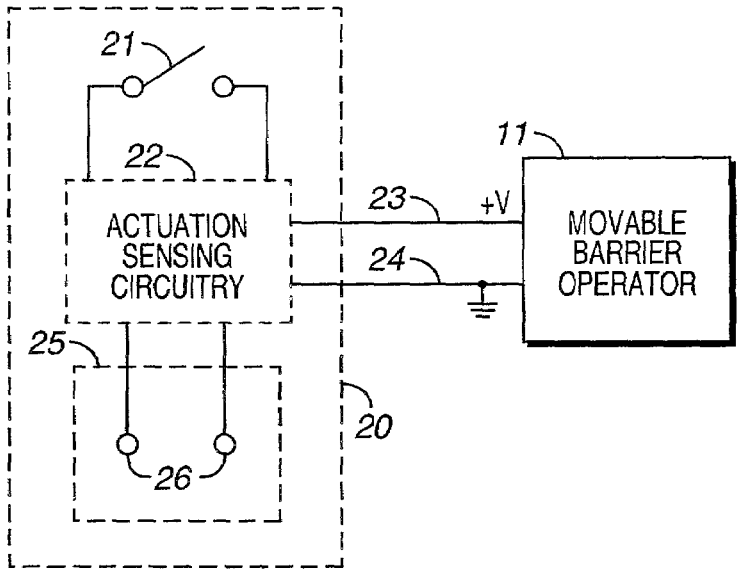
FIG. 2 comprises a block diagram as configured in accordance with various embodiments of the invention.

With reference to FIG. 2, a fixed-position remote control unit 20 will typically connect to the movable barrier operator 11 via two conductive wires 23 and 24. Other arrangements are of course possible, including one wire links and three or more wire links. Two wire links usually provide a first conductor 23 that supports a voltage (which voltage may be constant, intermittent, or fluctuate in accordance with varying design parameters) and a second conductor 24 that serves as a ground or return path. The closed and opened state of a switch 21 at the fixed-position remote control unit 20 is usually ascertained at the movable barrier operator 1. For example, as well understood in the art, probe circuits can be used to charge capacitors of differing values that are associated with different switches and to then detect both that a switch is closed, and which switch is closed by monitoring the corresponding discharge behavior. In such an embodiment, the switch 21 (or switches) (and their corresponding capacitors, if any) are directly coupled to the wired link 23 and 24, and the switch status sensing is effected at the movable barrier operator 11. If desired, however, switch actuation sensing circuitry 22 can optionally be provided at the fixed-position remote control unit 20 to detect the switch status and provide the resultant indicia to the movable barrier operator 11.

Many movable barrier operators 11 are also configured to monitor the link 23 and 24 to the fixed-position remote control unit 20, from time to time, for valid serial communications (such as digital control signals in the form of RS232 compliant data). When such data is detected, the movable barrier operator 11 can be configured to lock itself into an appropriate data mode for a fixed or variable duration of time to allow for an exchange of data. In this way, service and/or programming tools can be coupled to the movable barrier operator 11 to permit diagnostic review, feature selection, function setting, parameter adjustments, and so forth.

In the various embodiments described herein, the fixed-position remote control unit 20 also includes an externally accessible plug-in module interface 25. The interface 25 will usually include two electrically conductive surfaces 26 that are coupled to the wired link 23 and 24 (either directly or through whatever circuitry, such as filters, amplifiers, debouncers, or the like may be appropriate for the intended application). So configured, peripheral mechanisms having a plug-in form factor can be coupled to the link between the remote control unit 20 and the movable barrier operator 11 without requiring removal or invasive access to the remote control unit 20 itself Such an arrangement allows voltage from the movable barrier operator 11 to be provided to the plug-in module and/or for one or more signals to be exchanged therebetween.

Figure 3:
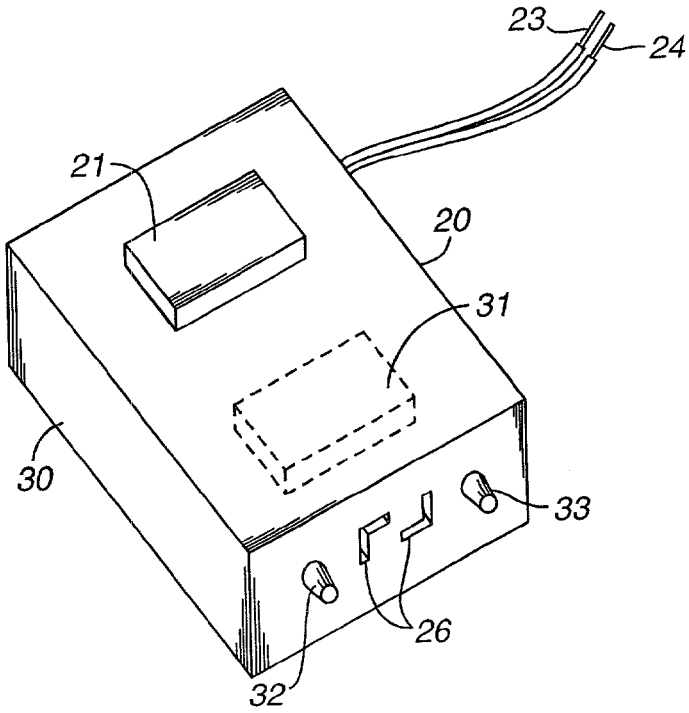
FIG. 3 comprises a perspective view of a remote control unit as configured in accordance with various embodiments of the invention.

Referring now to FIG. 3, the remote control unit 20 will typically include a housing 30. The housing 30 may have any form factor and/or size to suit the particular design requirements of a given application. Often, the housing 30 will have holes (not shown) on a back surface through which mounting screws or bolts can be placed to affix the housing 30 to, for example, a wall or door frame. Other attachment mechanisms can of course be used as desired. A user interface that includes, in this embodiment, a push button 21 allows at least one movable barrier operator 11 function to be controlled by a user from the remote control unit 20. If desired one or more additional buttons 31 can be further included, as can one or more signal lights or other display indicia.

As noted above, the remote control unit 20 also includes an externally accessible plug-in module interface. Such an interface will usually at least include at least one electrical interface and will also usually include a mechanical interface to ensure proper positioning of the plug-in module with respect to the electrical interface and/or to aid in holding the plug-in module in place. In this embodiment, the interface includes two cylindrical projections 32 and 33 that at least aid in guiding the plug-in module to a proper orientation and aid in preventing small sheer stresses or impacts from dislodging the plug-in module when docked. The plug-in module interface also includes, in this embodiment, two electrical connectors 26, wherein each electrical connector 26 operably couples to one of the movable barrier interface wires 23 and 24 as described above.

Figure 4:
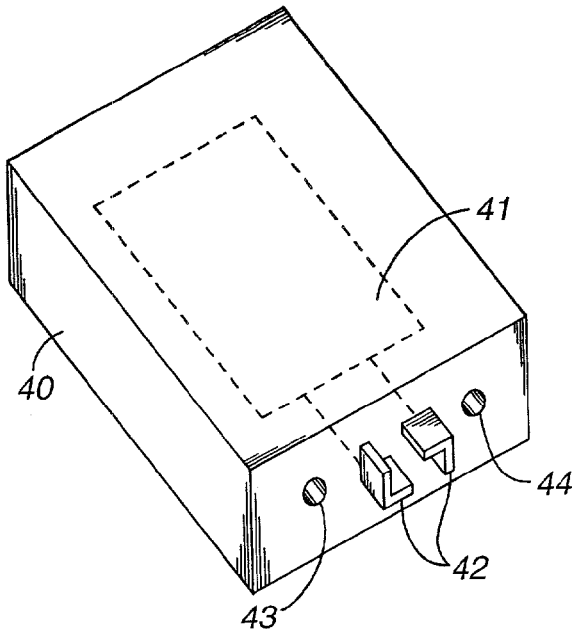
FIG. 4 comprises a perspective view of a plug-in module as configured in accordance with various embodiments of the invention.

So configured, the remote control unit 20 can readily physically and electrically couple to a plug-in module having the appropriate corresponding form factor. For example, and referring now to FIG. 4, a plug-in module 40 will typically have a housing that includes relevant electrical circuitry disposed therein and mechanical/electrical features that correspond to the plug-in module interface on the remote control unit 20. In this embodiment, the plug-in module 40 includes holes 43 and 44 of an appropriate size and disposition to permit registration with the cylindrically-shaped guides 32 and 33 as provided on the remote control unit 20 described with respect to FIG. 3. The plug-in module 40 also includes protruding members 42 that are either comprised of conductive material or that have an electrically conductive surface disposed thereon. A plug-in module 40 configured in this manner can be readily joined to the remote control unit 20 illustrated in FIG. 3 such that the electrical circuitry 41 in the plug-in module 40 can be operably coupled to the movable barrier operator interface. So joined, and depending upon the nature of the movable barrier operator interface itself as described above, the electrical circuitry 41 of the plug-in module 40 can be powered by the voltage that is supplied on that interface (for immediate use and/or to charge a portable power supply in the plug-in module 40) and/or can receive signaling from or provide signaling to the movable barrier operator 11. For example, when the movable barrier operator 11 supports RS232 digital signaling on the interface, the plug-in module 40 can use compliant signaling to facilitate such an exchange of information.

Figure 5:
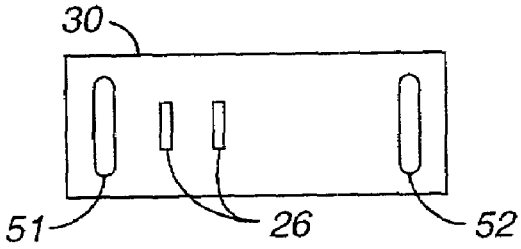
FIG. 5 comprises an end elevational view of a remote control unit as configured in accordance with an embodiment of the invention.
Figure 6:
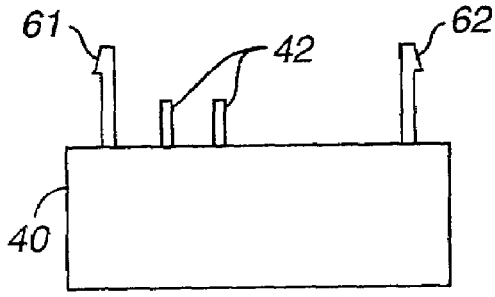
FIG. 6 comprises a partial top plan view of a plug-in module as configured in accordance with an embodiment of the invention.

It should be understood that the particular mechanical and electrical plug-in module interface described above is intended to be illustrative only, as there are numerous ways in which such a coupling can be reasonably fashioned. For example, with reference to FIGS. 5 and 6, the remote control unit housing 30 can have slots 51 and 52 formed therein to receive resilient prongs 61 and 62 having stop surfaces jutting therefrom as formed on a plug-in module 40 such that the plug-in module 40 will be mechanically held in place once the two components are coupled as described. Similarly, in this particular embodiment, the electrical interface can feature conductive slots 26 in the housing 30 of the remote control unit that receive conductive blades 42 that extend outwardly of the plug-in module 40.

Figure 7:
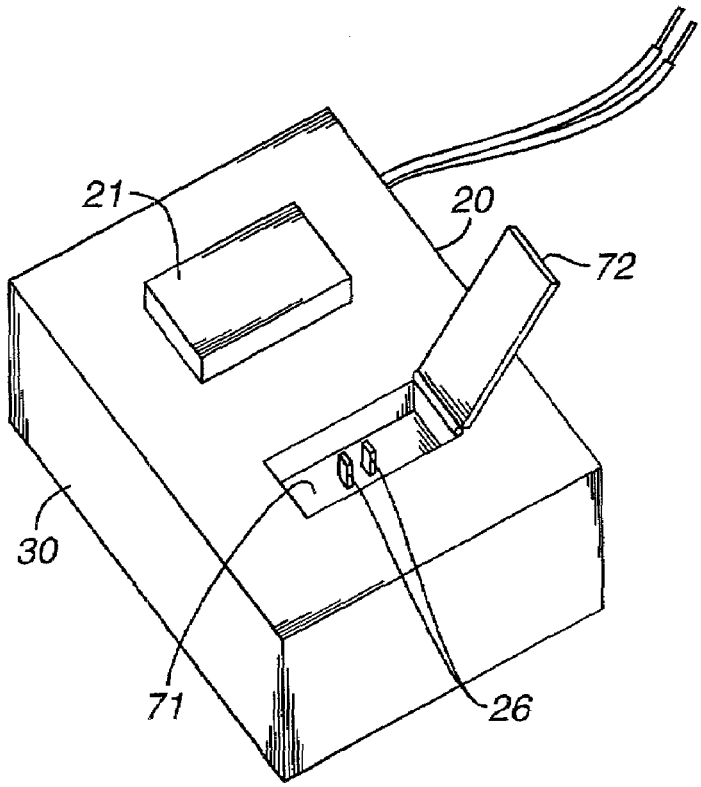
FIG. 7 comprises a perspective view of a remote control unit as configured in accordance with another embodiment of the invention.

It should also be understood that although the plug-in module interface should be externally accessible with respect to the remote control unit housing, it is not required that the interface be exposed at all times. If desired, and referring now to FIG. 7, the remote control unit housing 30 can have a cavity 71 formed therein to accommodate the interface. If desired, the surface shape of the housing 30 itself can also serve to conform to a corresponding surface on the plug-in module such that the plug-in module is guided and/or at least partially held in place by the resultant conformal interaction. Also if desired, a door 72 can be provided to occlude the cavity 71 until such time as access to the cavity 71 and the plug-in module interface is required.

Figure 8:
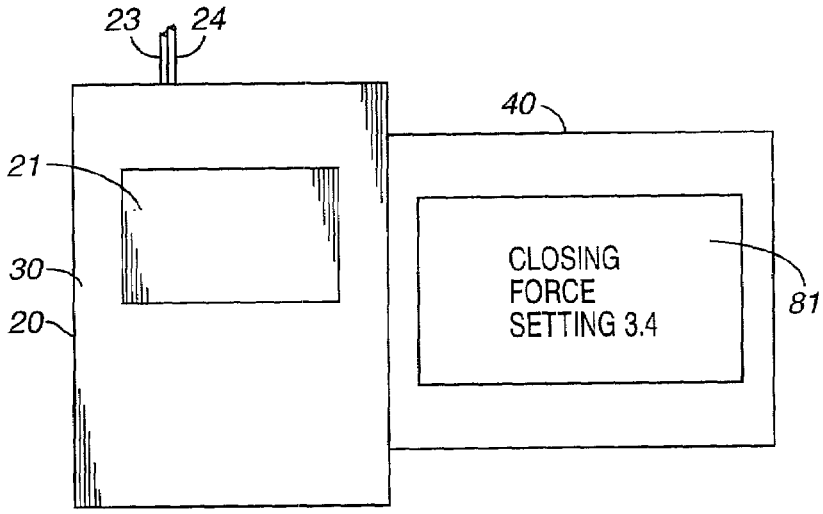
FIG. 8 comprises a front elevational view of a plug-in module as coupled to a remote control unit as configured in accordance with various embodiments of the invention.
Figure 9:
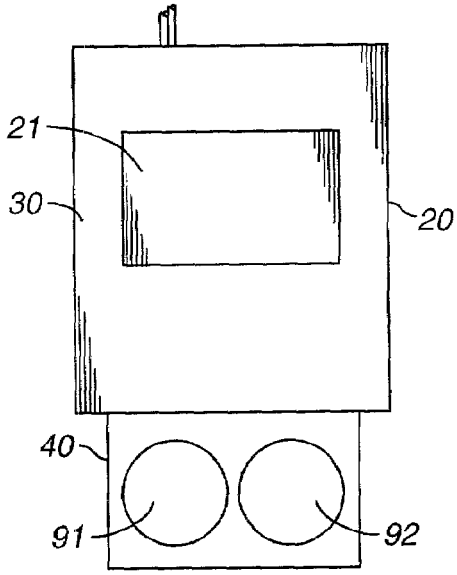
FIG. 9 comprises a front elevational view of a plug-in module as coupled to a remote control unit as configured in accordance with another embodiment of the invention.

Because the plug-in module interface can, depending upon the embodiment, provide power and/or a signaling interface to the movable barrier operator 11, a wide variety of plug-in modules can be readily accepted by a remote control unit having such an interface. For example, the plug-in module could be any of:

- A rechargeable flashlight that, when docked with the remote control unit 20, charges its internal battery or batteries using the voltage from the movable barrier operator;
- A passive infrared module that draws operating power from the available voltage and which provides sensor signals to the movable barrier operator to indicate when a moving human is in the vicinity (such information can be used in various known ways to effect lighting control, modify movement of the movable barrier, serve as a detection mechanism for unauthorized individuals, and so forth);
- A movable barrier operator service tool that exchanges signaling with the movable barrier operator to permit modified functionality, software upgrading, diagnostic testing, and so forth of the movable barrier operator;
- A supplemental movable barrier operator user interface to provide convenient control over already existing features or to provide control over newly added features (for example, with reference to FIG. 9, the plug-in module 40 can provide two potentiometers 91 and 92 that serve in a known fashion as force settings for upward and downward movement of the movable barrier; while such controls are often located on the movable barrier operator itself, this plug-in module 40 would permit convenient location of parallel controls proximal the fixed-position remote control unit 20 itself);
- A display (such as a monochrome or color liquid crystal display) to allow temporary display of, for example, diagnostic information or more permanent display of, for example, state information (for example, with reference to FIG. 8, the plug-in module 40 can include a liquid crystal display 81 to present current parameter settings as stored and used by the movable barrier operator 11);
- A movable barrier operator programming tool that permits a user (as versus, for example, a service technician) to view and/or alter user-accessible functionality of the movable barrier operator 11 such as, for example, time-out settings for various lighting events, security codes, course and/or fine force settings, and so forth;
- A status transmitter (or transceiver) to wirelessly transmit information gleaned from the movable barrier operator regarding one or more monitored states (for example, the plug-in module can receive an indication from the movable barrier operator whenever the movable barrier is not fully closed and transmit a corresponding short range signal to a user receiver to thereby alter the user of this status);

An audio transducer to permit one or more audible signals (ranging from single tones to complete melodies or polyphonic performances) to be generated in response to predetermined events such as opening of the movable barrier, detecting an obstacle in the path of the movable barrier, and so forth; or A portable wireless remote control unit for the movable barrier operator wherein the portable wireless remote control unit has its portable power supply recharged when it is docked to the fixed position remote control unit.

Many other plug-in modules are of course possible and the above are intended as a non-inclusive listing of reasonable candidates only. It should be clear that providing a remote control unit having an externally accessible plug-in module interface greatly expands opportunities to add various features to the corresponding movable barrier operator and/or to simply take advantage of the convenient availability of electric power. The interface itself costs little and therefore does not significantly adversely affect the overall price of a basic system. The consumer can then select and pay for only those additional features that are genuinely desired, thereby assuring strong correlation between the desired system and the corresponding price. Furthermore, later developed features can be readily added in many instances to a previously installed movable barrier operator, thereby further protecting the initial investment in the system.

Figure 10:
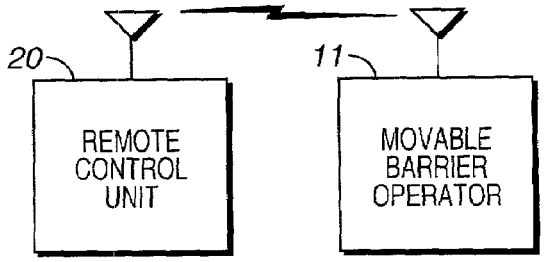
FIG. 10 comprises a block diagram as configured in accordance with another embodiment of the invention.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. For example, as depicted in FIG. 10, instead of a wired link between the fixed position remote control unit 20 and the movable barrier operator 11, a wireless link can be used. While power is no longer available from the movable barrier operator 11, signaling can still be exchanged as otherwise described above to achieve the same results and benefits.

We claim:

1. A remote control unit for use with a movable barrier operator, comprising:

a housing adapted and configured to be remotely mounted from the movable barrier operator;

at least one user interface that is at least partially disposed within the housing and that is at least partially accessible on an exterior surface of the housing;

a movable barrier interface that operably couples to the at least one user interface to the movable barrier operator and that carries at least one of voltage from the movable barrier operator and a signal;

an externally accessible plug-in module interface that is discrete and separate from the at least one user interface.

2. The remote control unit of claim 1 wherein the at least one user interface includes a push-button switch.

3. The remote control unit of claim 2 wherein the at least one user interface includes a plurality of push-button switches.

4. The remote control unit of claim 1 wherein the at least one user interface includes a movable barrier movement actuator.

5. The remote control unit of claim 1 wherein the movable barrier interface includes at least two electrical conductors operably coupled between the remote control unit and the movable barrier operator.

6. The remote control unit of claim 5 wherein the at least two electrical conductors support both voltage from the movable barrier operator and the signal.

7. The remote control unit of claim 1 wherein the signal comprises a control signal.

8. The remote control unit of claim 7 wherein the control signal includes a digital control signal.

9. The remote control unit of claim 1 wherein the movable barrier interface includes a wireless link operably coupled between the remote control unit and the movable barrier operator.

10. The remote control unit of claim 1 wherein the externally accessible plug-in module interface includes at least one externally exposed electrical conductor.

11. The remote control unit of claim 1 wherein the housing further includes a cavity formed therein and wherein at least a part of the externally accessible plug-in module interface is disposed within the cavity.

12. The remote control unit of claim 11 wherein the housing further includes an access door disposed proximal the cavity and being selectively positionable between a first position wherein the cavity is occluded and a second position wherein the cavity is observable.

13. The remote control unit of claim 1 wherein the externally accessible plug-in module interface includes a docking interface.

14. The remote control unit of claim 13 wherein the docking interface includes at least one latching mechanism.

15. The remote control unit of claim 13 wherein the docking interface includes at least one surface shape adapted and configured to conform to a surface on a plug-in module.

16. The remote control unit of claim 13 wherein the externally accessible plug-in module interface includes at least one of a male and female member adapted and configured to cooperatively interact with a corresponding feature on a plug-in module.

17. The remote control unit of claim 1 wherein the externally accessible plug-in module interface is electrically coupled to the movable barrier interface.

18. The remote control unit of claim 17 wherein the externally accessible plug-in module interface includes at least one electrically conductive surface and wherein the at least one electrically conductive surface provides voltage from the movable barrier operator.

19. A remote control unit comprising:

a housing adapted and configured to be remotely mounted from the movable barrier operator;

at least one user interface that is at least partially disposed within the housing and that is at least partially accessible on an exterior surface of the housing;

a movable barrier interface that operably couples to the at least one user interface to the movable barrier operator and that carries at least one of voltage from the movable barrier operator and a signal;

an externally accessible plug-in module interface that is electrically coupled to the moveable barrier interface and wherein the externally accessible plug-in module interface includes at least one electrically conductive surface and wherein the at least one electrically conductive surface, when a plug-in module is operably coupled to the externally accessible plug-in module interface, supports signals between the plug-in module and the movable barrier operator.

20. A remote control unit for use with a movable barrier operator, comprising:

housing means for providing a housing that is remotely mounted from the movable barrier operator;

user interface means integrally disposed with respect to the housing means and being accessible by a user from an exterior of the housing means for receiving a user-initiated actuation signal;

movable barrier operator interface means for operably coupling the user interface means to the movable barrier operator and for carrying at least one of voltage from the movable barrier operator to the remote control unit and signal therebetween; and plug-in module interface means that is discrete and separate from the user interface means and that is integrally disposed with respect to the housing means for operably coupling a plug-in module to the movable barrier operator interface means.

21. A remote control unit for use with a movable barrier operator, comprising:

housing means for providing a housing that is remotely mounted from the movable barrier operator;

user interface means integrally disposed with respect to the housing means and being accessible by a user from an exterior of the housing means for receiving a user-initiated actuation signal;

movable barrier operator interface means for operably coupling the user interface means to the movable barrier operator and for carrying at least one of voltage from the movable barrier operator to the remote control unit and signal therebetween; and plug-in module interface means that is integrally disposed with respect to the housing means for operably coupling a plug-in module to the movable barrier operator interface means, wherein the plug-in module interface means further provides voltage from the movable barrier operator to the plug-in module.

22. The remote control unit of claim 20 wherein the plug-in module interface means further supports a transfer of signaling between the movable barrier operator and the plug-in module.

23. The remote control unit of claim 21 wherein the plug-in module interface means further:

provides voltage from the movable barrier operator to the plug-in module; and supports a transfer of signaling between the movable barrier operator and the plug-in module.

* * * * *